US007278229B1

(12) United States Patent
Fen

(10) Patent No.: US 7,278,229 B1
(45) Date of Patent: Oct. 9, 2007

(54) IRONING BOARD STORAGE DEVICE

(75) Inventor: Wen Chang Fen, Guangzhou (CN)

(73) Assignee: Whitney Design, Inc., Bridgeton, MO (US)

( * ) Notice: Subject to any disclaimer, the term of this patent is extended or adjusted under 35 U.S.C. 154(b) by 0 days.

(21) Appl. No.: 11/515,645

(22) Filed: Sep. 5, 2006

(51) Int. Cl.
*D06F 81/06* (2006.01)
*A47B 37/00* (2006.01)
*A47B 81/00* (2006.01)
*A47B 43/00* (2006.01)

(52) U.S. Cl. ..... 38/137; 38/106; 38/107; 108/42; 312/21

(58) Field of Classification Search ..... 38/137, 38/139, 103, 106; 108/39, 40, 33, 48, 42; 312/21, 242, 245, 350
See application file for complete search history.

(56) References Cited

U.S. PATENT DOCUMENTS 1,110,903 A * 9/1914 Cox ..... 108/40
1,136,878 A * 4/1915 Hornschuch ..... 38/103
1,532,973 A * 4/1925 Adelson ..... 108/39
1,679,581 A 8/1928 McCray
1,682,640 A 8/1928 Thompson
1,684,378 A * 9/1928 Ackerman ..... 108/33
1,696,145 A 12/1928 Wagoner
2,358,906 A 9/1944 Bullard
2,527,682 A 10/1950 Lyon
2,549,723 A 4/1951 Thatcher
4,834,332 A 5/1989 Vanderbilt
4,909,158 A 3/1990 Sorensen
D315,068 S 3/1991 Miller
D316,169 S 4/1991 Bryan et al.
5,452,531 A 9/1995 Graville et al.
5,669,314 A * 9/1997 Grant ..... 108/48
6,026,601 A * 2/2000 Kiel ..... 38/137
7,062,871 B1 * 6/2006 Smidt ..... 38/104
7,100,316 B2 * 9/2006 Obileye ..... 38/139

* cited by examiner

*Primary Examiner*—Ismael Izaguirre
(74) *Attorney, Agent, or Firm*—Polster, Lieder, Woodruff & Lucchesi

(57) ABSTRACT

The present invention is an ironing board storage device that removably attaches to a wall and rests on a support surface. The device includes an ironing board moveably mounted within a housing and a lift mechanism operatively engaged with the ironing board that can automatically move the ironing board upwardly from a generally vertical storage position with a distal end positioned beneath the proximal end to a generally horizontal operating position. A guide assembly is operatively engaged with the ironing board to initiate and guide the movement of the ironing board. In addition, the guide assembly secures the ironing board in the operating position.

40 Claims, 12 Drawing Sheets

IRONING BOARD STORAGE DEVICE

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

This invention relates to ironing boards for use with an iron to iron clothes, and more specifically to storage devices for storing ironing boards. Ironing board storage devices have taken a variety of constructions, but typically have been comprised of a retractable ironing board movably mounted within a cabinet that is concealed in an interior cavity of a wall. The cabinet is installed at an appropriate height so that the ironing board can be rotated downwardly to a generally horizontal operating position relative to the floor. When not in use, the ironing board can be rotated upwardly to a generally vertical position within the cabinet for storage and a door closed to conceal the ironing board.

These types of ironing board storage devices are difficult to install and require major repair work if removed. To install, one must make large openings in an existing wall and properly support the storage device from support studs or the like, which calls for the use of many tools and a great deal of manual labor. For this reason, once the devices are installed they are rarely removed, making the installation effectively permanent. In addition, the location of the storage device is limited by the location of the support studs in the wall. Furthermore, these types of ironing board storage devices do not contain adequate support for the ironing board when placed in the operating position. As a result, the ironing board is not particularly stable and is susceptible to movement during operation.

Prior art ironing board assemblies have also included collapsible shelves movably mounted relative to leg stands, which can be located beneath the ironing board. However, these shelves have been limited to use with stand alone ironing boards and have not been used in conjunction with ironing board storage devices.

Therefore, there has been a need for an ironing board storage device that is easy to install, can be easily relocated, and is adequately stable during operation. There is also a need for a shelf device used in conjunction with the storage device.

SUMMARY OF THE INVENTION

Briefly stated, the invention is an ironing board storage device having a housing, an ironing board movably, preferably pivotally, connected to the housing for movement between a substantially horizontal ironing position wherein the ironing board proximal end is closer to the housing than the ironing board distal end, and a substantially vertical storage position wherein the ironing board proximal end is above the ironing board distal end, and a lift mechanism operatively associated with the ironing board capable of automatically raising the ironing board upwardly in a pivotal movement, preferably in a substantially horizontal ironing position.

The foregoing and other features, and advantages of the invention as well as embodiments thereof will become more apparent from the reading of the following description in connection with the accompanying drawings.

DESCRIPTION OF THE DRAWINGS

In the accompanying drawings which form part of the specification.

Corresponding reference numerals indicate corresponding parts throughout the several figures of the drawings.

DETAILED DESCRIPTION

Figure 1:
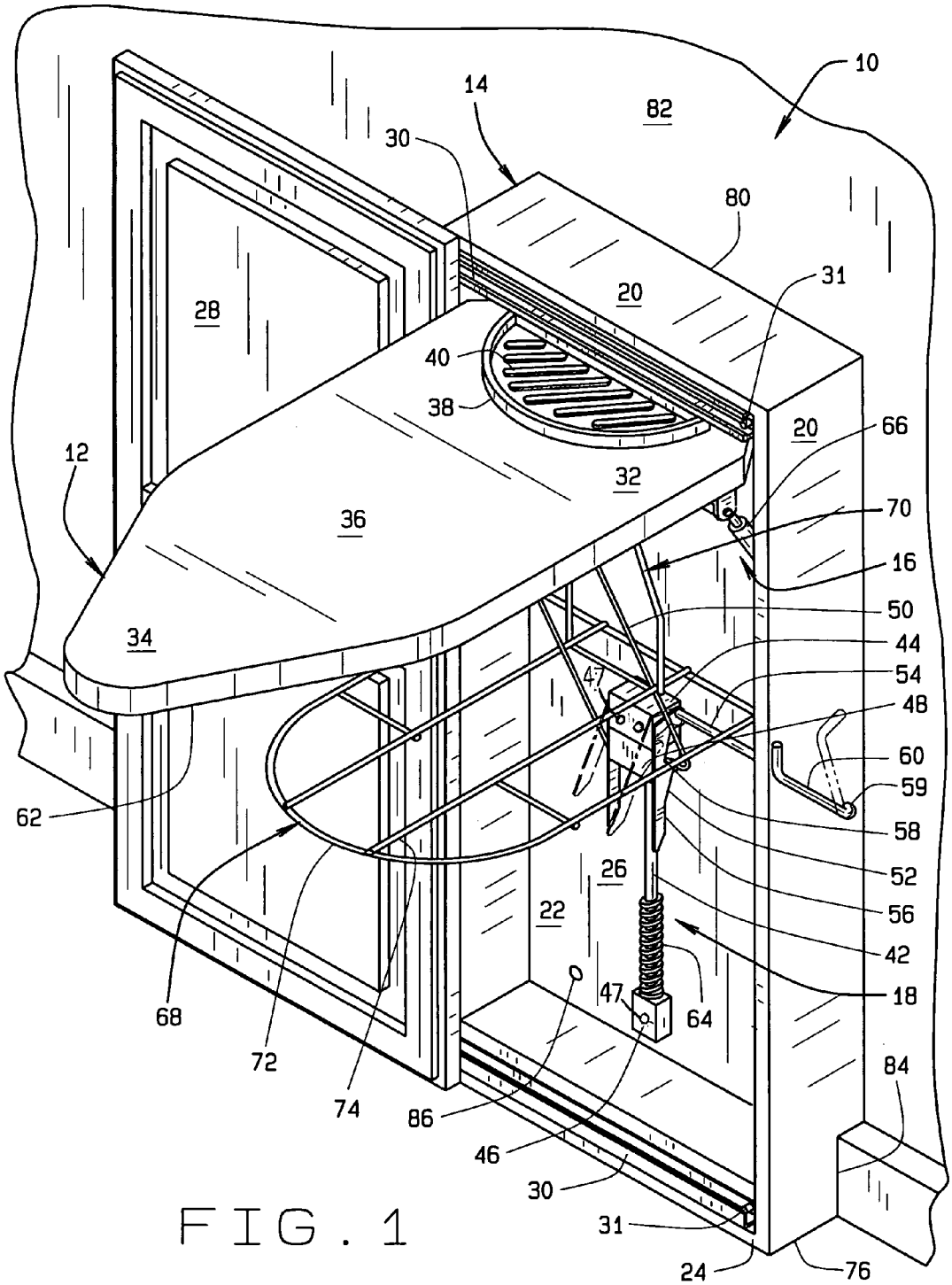
FIG. 1 is a perspective view of a first embodiment of the invention shown as an ironing board storage device in an operating position.

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways.

Also, it is to be understood that the phraseology and terminology used herein is for the purpose of description and should not be regarded as limiting.

As shown in FIGS. 1-4, an embodiment of the present invention, generally referred to as a ironing board storage device 10, includes an ironing board 12 with a distal end 34 and a proximal end 32 moveably mounted, preferably pivotally, within a housing 14 and a lift mechanism 16 operatively engaged with the ironing board 12 that can automatically move the ironing board 12 upwardly from a generally vertical storage position with the distal end 34 positioned beneath the proximal end 32 (FIG. 3) to a generally horizontal operating position (FIG. 1) with the proximal end 32 being closer to the housing 14 than the distal end 34. A guide assembly 18 is operatively engaged with the ironing board 12 to initiate and guide the movement of the ironing board 12. In addition, the guide assembly 18 secures the ironing board 12 in the operating position.

The housing 14 is a generally rectangular box having sidewalls 20 extending from a rear panel 22 to define a front face 24 and a cavity 26 for storing the ironing board 12. A door 28 is moveably mounted to the housing 14 with door slides 30, such as drawer slides or the like, so that the door 28 slides between an open position and a closed position across the front face 24 of the housing 14. Stops 31 are located at the end of each slide 30 to prevent the door 28 from sliding too far. Although the embodiment of FIGS. 1-4 discloses the door 28 mounted for sliding from right to left to arrive at the open position, those skilled in the art will recognize that the door 28 can be also mounted for sliding from left to right to arrive at the open position. Also, those skilled in the art will recognize that the door 28 can also be mounted to the housing 14 using any method known in the art, such as hinges. In alternate embodiments, the door can be removed altogether or replaced with various coverings to visually hide the interior of the housing, such as a collapsible screen or panel, a retractable shade, bi-fold door, and the like.

The ironing board 12 is embodied as a typical ironing board with a generally rectangular proximal portion 32 and a generally narrowing nose distal portion 34, such as a narrowing nose, the proximal portion 32 being moveably mounted, preferably pivotally, at an upper end of the cavity 26 and supported by the guide assembly 18. However, those skilled in the art will recognize that any shape of ironing board can be used. A cover 36 fits over the ironing board 12 and includes a binding (not shown), including but not limited to a bungee cord, elastic, or drawstring, positioned around the perimeter of the cover 36 for securing the cover 36 to the ironing board 12. The cover 36 can be made of cotton as known in the art, or can be made from material with burn/scorch resistant characteristics, such as disclosed in U.S. Pat. No. 5,566,481. In other embodiments, the cover 36 includes multiple layers of materials, including but not limited to a layer of foam padding.

A heat-resistant and waterproof panel 38 can be secured to the ironing board cover 36, such as the panel disclosed in U.S. patent application Ser. No. 11/221,069, hereby incorporated by reference, for preventing damage to the cover 36 by an iron (not shown). When the iron is placed with an ironing surface facing the panel 38, the iron is supported by protuberances 40 so that a gap is formed between the ironing surface and the iron to allow steam to flow through the gap about the protuberances and condense in the basin. Those skilled in the art will recognize that other heat-resistant and/or waterproof panels can be used. While the present embodiment shows a generally rectangular shaped panel 38 secured to a rear portion of the cover 36, other shapes, including but not limited to circular, trapezoidal, or oblong can be provided. Further, other sizes and locations can be used. If desired, the ironing board storage device 10 can be used without the waterproof panel 38.

Figure 5:
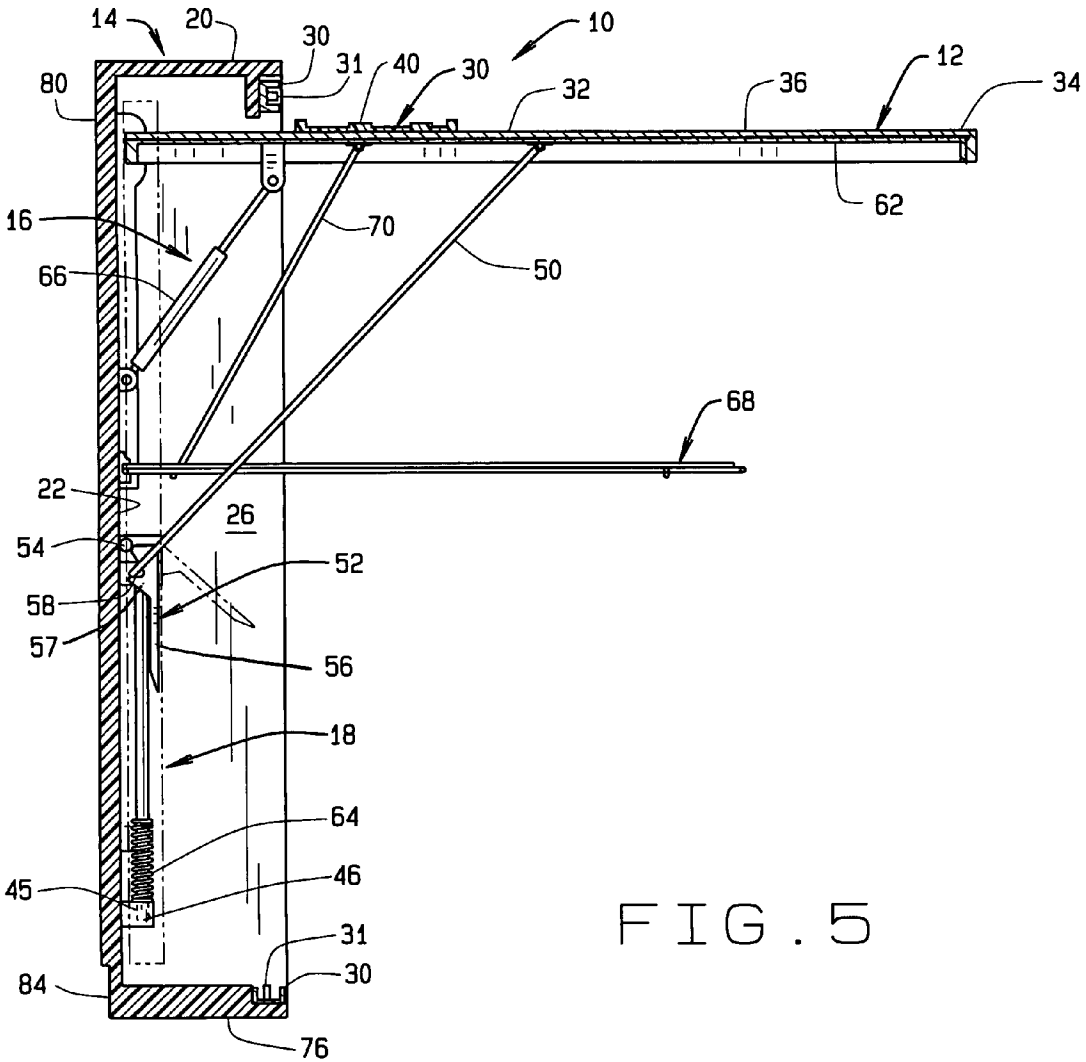
FIG. 5 is a section view of the first embodiment of the invention shown as the ironing board storage device along A-A of FIG. 1.
Figure 6:
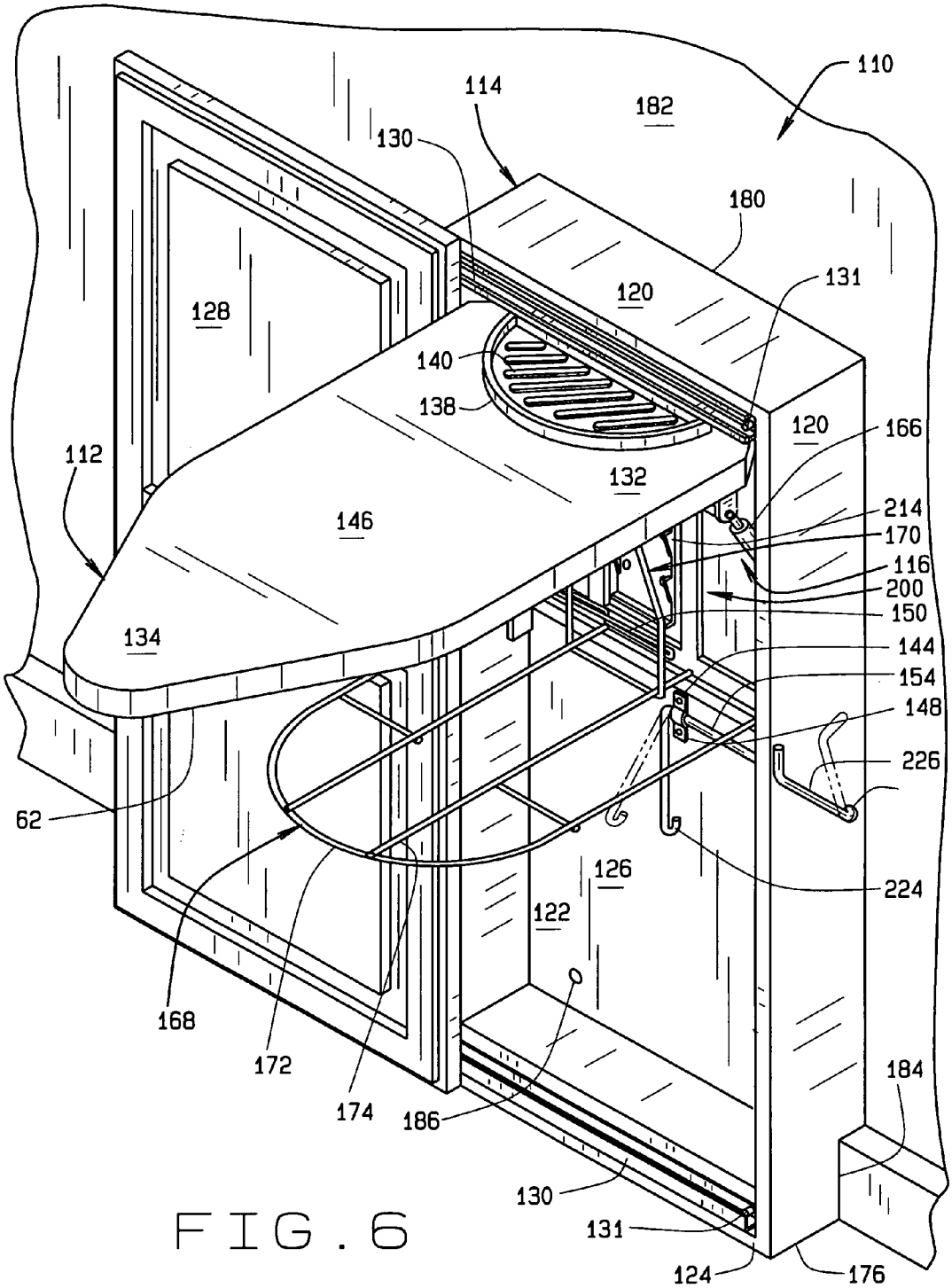
FIG. 6 is a perspective view of a second embodiment of the invention shown as an ironing board storage device in an operating position.

The guide assembly 18 (FIG. 5) includes a vertical guide rod 42 mounted to the rear panel 22 of the housing 14 with a pair of mounting blocks 44 and 46. The blocks 44 and 46 include bores 45 for receiving the guide rod 42, and mount to the rear panel 22 with fasteners 47, such as screws, bolts, nails, and the like. A guide block 48 has bores 49 sized to snugly but slidably receives the guide rod 42 so that the guide block 48 can slide upwardly and downwardly along the guide rod 42. A support brace 50, comprising a generally rectangular bar, moveably, preferably pivotally, connects between the guide block 48 and the ironing board 12 to correlate the movement of the guide block 48 with the movement of the ironing board 12. As a result, when the guide block 48 slides upwardly and downwardly along the guide rod 42, the ironing board 12 pivots between the operating position and the storage position. The support brace 50 is shown preferably generally flat with a generally rectangular configuration although it can have other shapes such as U-shaped, circular, elliptical, oblong, and square.

When the ironing board 12 is in the operating position, the support brace 50 engages a latch 52 for support during operation. The latch 52 is a generally horizontal bar 54 moveably, preferably pivotally, attached to the upper mounting block 44 and having arms 56 extending perpendicularly from the bar 54, which are adjacent each side of the upper mounting block 44. Each arm 56 includes sloped portions 57 and a notch 58 that engages and receives the support brace 50 as the ironing board 12 pivots to the operating position. As the ironing board 12 pivots upwardly, the support brace 50 contacts the sloped portions 57, which pivots the arms 56 upwardly until the notches 58 receive the support brace 50. Upon being received by the notch 58, the arms 56 pivot downwardly due to gravity so that the notch 58 engages the support brace 50 and supports the ironing board 12 in the operating position. In this way, the support brace 50 stabilizes the ironing board 12 during operation. The bar 54 extends through bores 59 in the vertical sidewalls 20 of the housing 14 and terminates in a handle 60. When the ironing board 12 is in the operating position, the operator can engage the handle 60 to pivot the arms 56 upwardly and release the support brace 50 so the ironing board 12 can be manually pivoted downward to the storage position. When the ironing board 12 is in the storage position, the operator can engage the handle 60 to pivot the arms 56 upwardly so that the arms 56 press against an ironing board lower surface 62 to initiate upward movement of the ironing board 12. Once upward movement is initiated by the latch 52, the lift mechanism 16 engages the ironing board 12 to automatically move it to the operating position.

The lift mechanism 16 includes biasing elements, such as a helical compression spring 64 mounted along the guide rod 42 and a pair of cylinders 66 moveably, preferably pivotally, mounted between the housing 14 and the ironing board 12. In the storage position, the cylinders 66 are generally parallel with and unable to extend and pivot the ironing board 12. For this reason, the latch 52 initiates the movement of the ironing board 12 and the compression spring 64 biases the guide block 48 upwards, thereby, pivoting the ironing board 12 upwards to an angle of about 20°. At this angle, the cylinders 66 extend to pivot the ironing board 12 upwardly to the operating position. Although the cylinders 66 of embodiment of FIGS. 1-4 are preferably air cylinders, any type of biasing element can be used, such as hydraulic cylinders or the like. In alternate embodiments, the compression spring can be replaced with other appropriate biasing elements and structured to orient biased movement of the ironing board to pivot upwardly, such as torsion springs, extension springs, conical springs, helical springs, leaf springs, spiral springs, cantilever springs, gas springs, Belleville springs, rubber bands, and the like. However, a helical compression spring, such as shown, is preferable because it is helical to provide better and more effective use of space, orientation, and material.

The storage device also includes a shelf 68 moveably, preferably pivotally, mounted to the housing 14 and operatively connected to the ironing board 12 with a shelf bracket 70. The shelf comprises a perimeter bar 72 having a generally U-shaped configuration and longitudinal struts 74, which are joined at their ends as by welding to the perimeter bar 72. The proximal end of the shelf 68 is moveably, preferably pivotally, attached to the rear panel 22 of the housing 14 so that the shelf can pivot upwards and downwards. The shelf bracket 70 moveably, preferably pivotally, attaches between the longitudinal struts 74 and the ironing board lower surface 62 so that the movement of the shelf 68 corresponds with the movement of the ironing board 12. Therefore, the shelf 68 remains generally parallel with the ironing board 12 as it moves between the storage position and the operating position. All of the described parts of the support 30 are preferably of metal, such as of stainless steel. They could be, however, of durable plastic or other suitable material. The shelf 30 is shown preferably generally flat with a generally U-shaped overall configuration although it can have other shapes such as for example circular, elliptical, oblong, or square.

When installed, a housing bottom surface 76 can rest on a surface, such as support surface 78, which is preferably a floor, with the rear panel outer surface 80 abutting a wall 82. The rear panel outer surface 80 can include a channel 84 for receiving molding, which is typically located along bottom edge of the wall 82, so the storage device 10 can abut flush against the wall 82. Because the housing 14 rests on the support surface 78, the storage device 10 can be secured to the wall 82 with a minimal amount of fasteners 86, such as anchor bolts, drywall screws, nails and the like. This allows the storage device 10 to be easily removed while only leaving small holes from the fasteners 86, which can easily be repaired. In addition, the placement of the storage device 10 is not limited by the location of any support studs within the wall 82.

Figure 2:
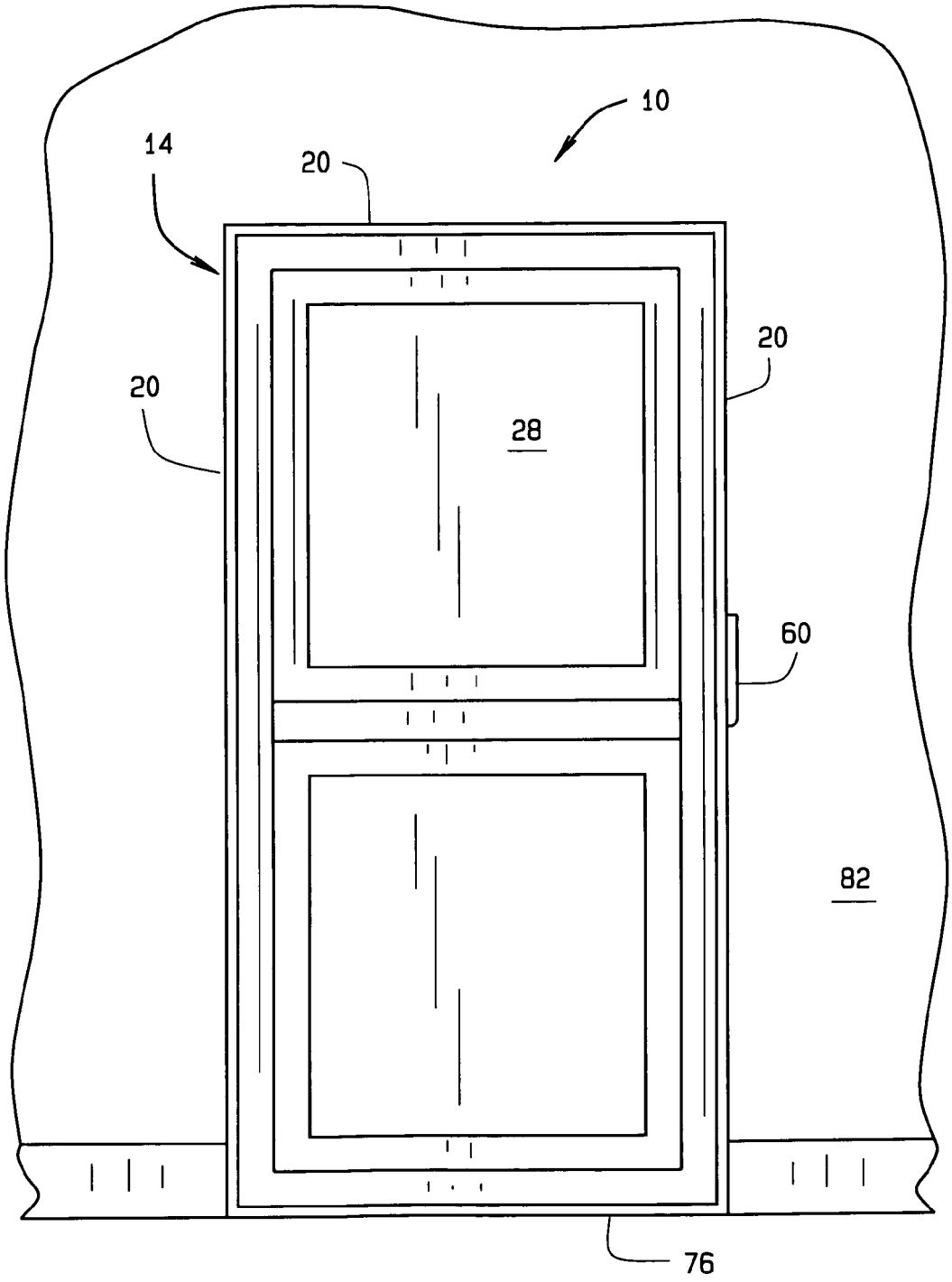
FIG. 2 is a front elevational view of the first embodiment of the invention shown as the ironing board storage device of FIG. 1 in a storage position, in accordance with the present invention.
Figure 3:
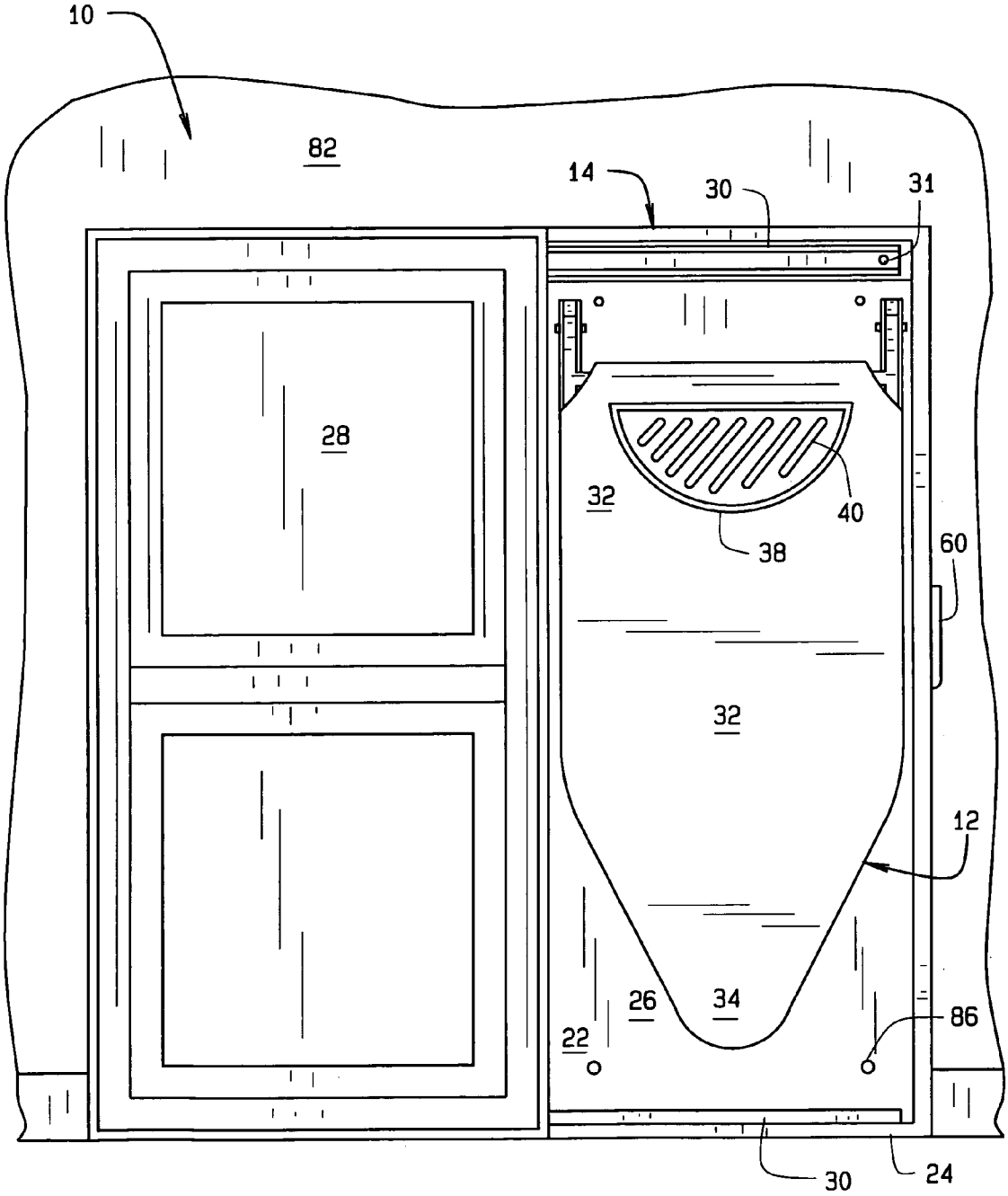
FIG. 3 is a front elevational view of the first embodiment of the invention shown as the ironing board storage device of FIG. 1 with a door in an open position and the ironing board in the storage position.
Figure 4:
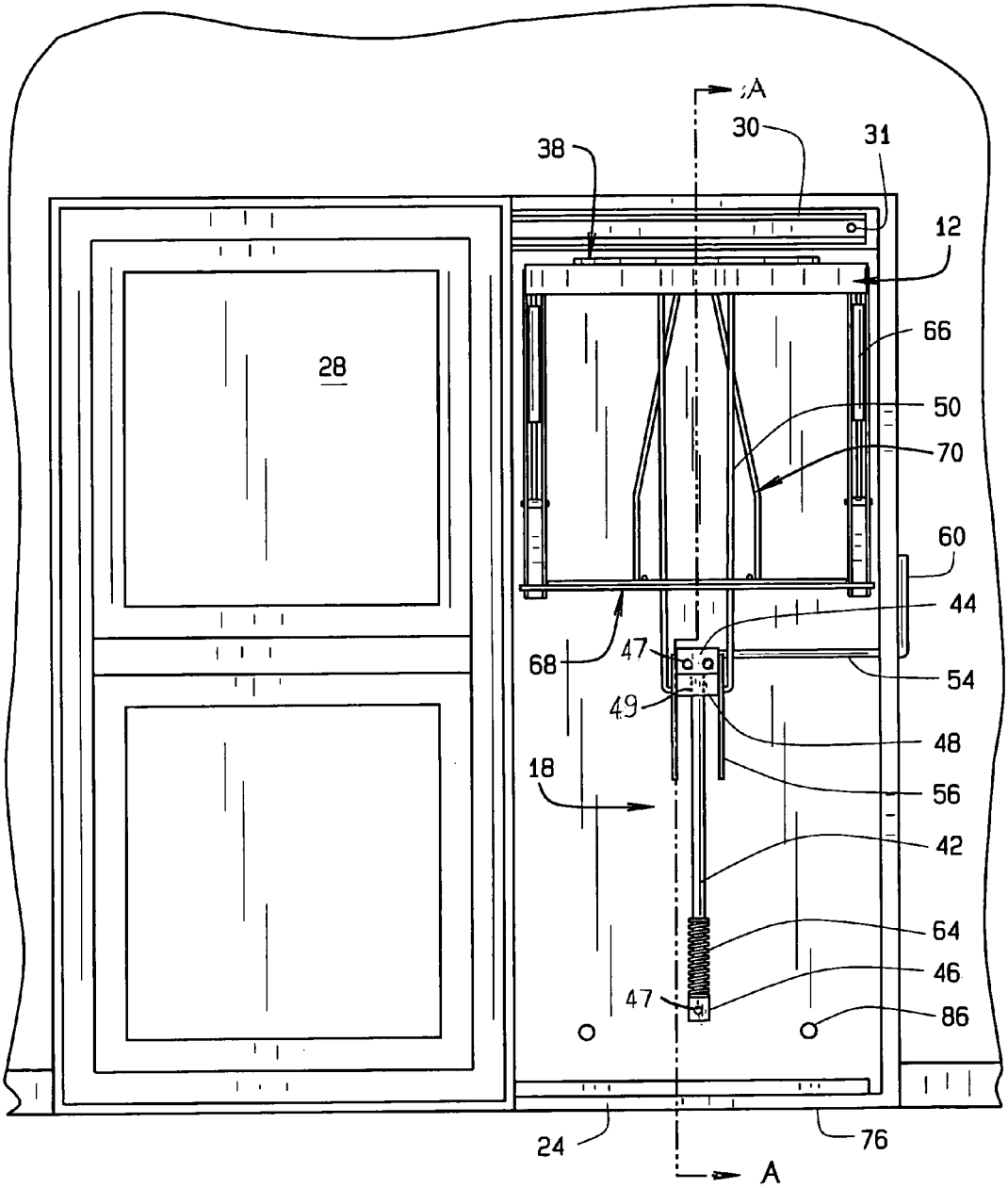
FIG. 4 is a front elevational view of the first embodiment of the invention shown as the ironing board storage device of FIG. 1 in the operating position.

In operation, the operator slides the door 28 to the open position to access the ironing board 12, as shown in FIG. 2. The operator engages the handle 60 to pivot the latch 52 and initiate the upward movement of the ironing board 12 from the storage position. The lift mechanism 16 automatically pivots the ironing board 12 upward until the latch 52 engages the support brace 50, thereby securing the ironing board 12 in the operating position. In this position, the ironing board 12 is located at an appropriate height for ironing. When the operator has finished ironing, he or she engages the handle 60 to release the support brace 50 from the latch 52. The operator manually pivots the ironing board 12 downwardly to the storage position and slides the door 28 to the closed position.

The present invention can be embodied in the form of the second embodiment of an ironing board storage device 110 as shown in FIGS. 6-12. While similar to the first embodiment, the ironing board storage device 110 of the second embodiment generally differs by including a vertically adjustable ironing board 112. In addition, a guide assembly 118 is mounted to the underside of the ironing board 112, rather than the rear panel 22 of the housing 14 as shown in the first embodiment of FIGS. 1-5.

For ease of understanding, components common between the first and second embodiments are identified with similar reference numbers, except the reference numbers in the second embodiment include a "100" prefix. For example, the housing of the first embodiment is identified as 14, while the second embodiment with a similar housing is identified as 114. Naturally, any new components are identified with unique reference numbers.

Figure 9:
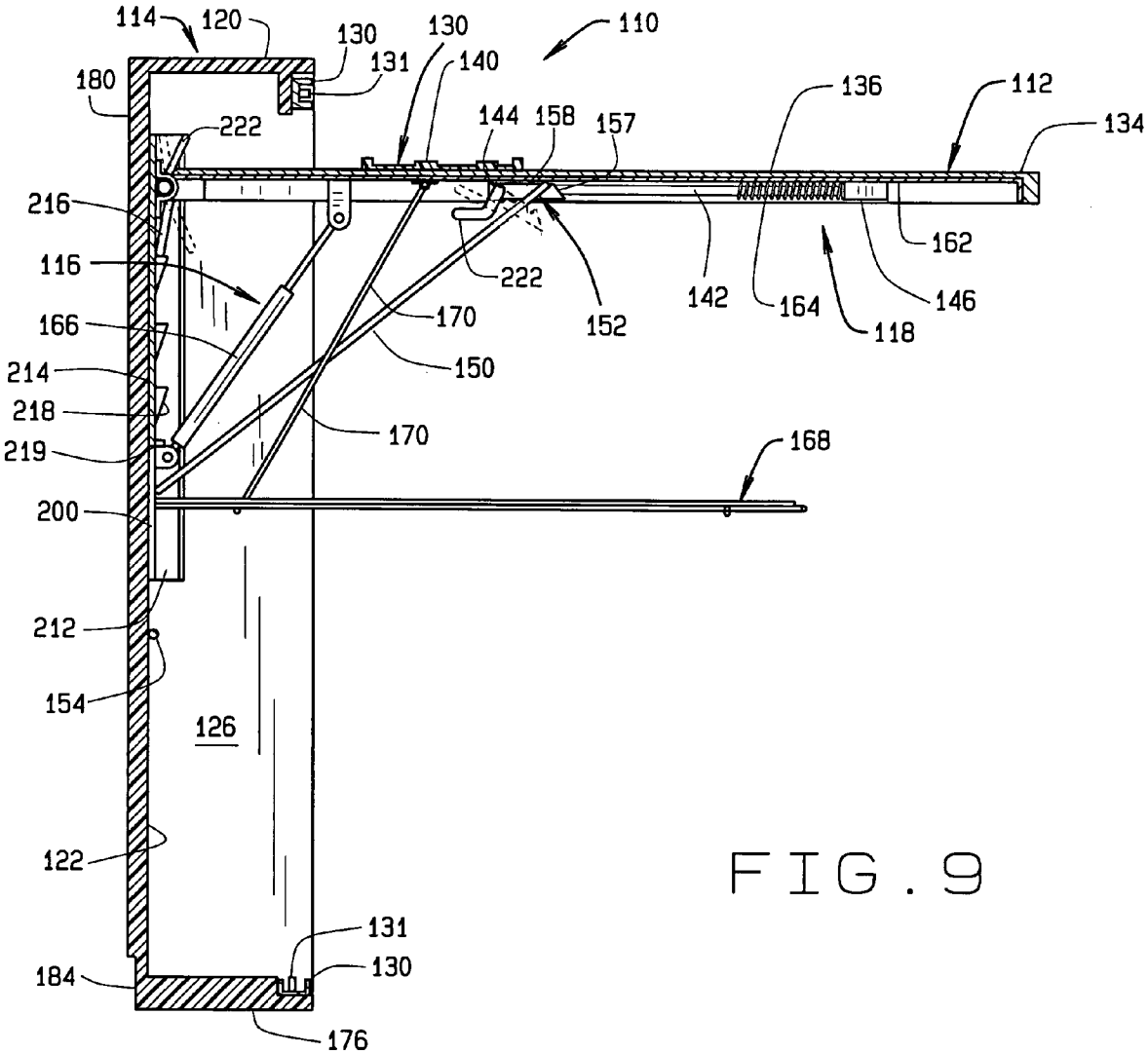
FIG. 9 is a section view of the second embodiment of the invention shown as the ironing board storage device along B-B of FIG. 7 with the door in an open position and the ironing board in the operating position at a highest elevation.

The ironing board storage device 110, includes an ironing board 112 with a distal end 134 and a proximal end 132 moveably mounted, preferably pivotally, to a vertically adjustable frame assembly 200 mounted within a housing 114. A lift mechanism 116 operatively engages with the ironing board 112 and the frame assembly 200. The lift mechanism 116 can automatically move the ironing board 112 upwardly from a generally vertical storage position with the distal end 134 positioned beneath the proximal end 132 (FIG. 7), to a generally horizontal operating position (FIG. 6) with the proximal end 132 being closer to the housing 114 than the distal end 134. A guide assembly 118 is operatively engaged with a lower surface 162 of the ironing board 112 and the frame assembly 200 to initiate and guide the movement of the ironing board 112 (FIG. 9). In addition, the guide assembly 118 secures the ironing board 112 in the operating position.

The housing 114 is a generally rectangular box having sidewalls 120 extending from a rear panel 122 to define a front face 124 and a cavity 126 for storing the ironing board 112. A door 128 is moveably mounted to the housing 114 with door slides 130, such as drawer slides or the like, so that the door 128 slides between an open position and a closed position across the front face 124 of the housing 114. Stops 131 are located at the end of each door slide 130 to prevent the door 128 from sliding too far. Although the embodiment of FIGS. 6-10 discloses the door 128 mounted for sliding from right to left to arrive at the open position, those skilled in the art will recognize that the door 128 can be also mounted for sliding from left to right to arrive at the open position. Also, those skilled in the art will recognize that the door 128 can also be mounted to the housing 114 using any method known in the art, such as hinges. In alternate embodiments, the door can be removed altogether or replaced with various coverings to visually hide the interior of the housing, such as a collapsible screen or panel, a retractable shade, bi-fold door, and the like.

Figure 8:
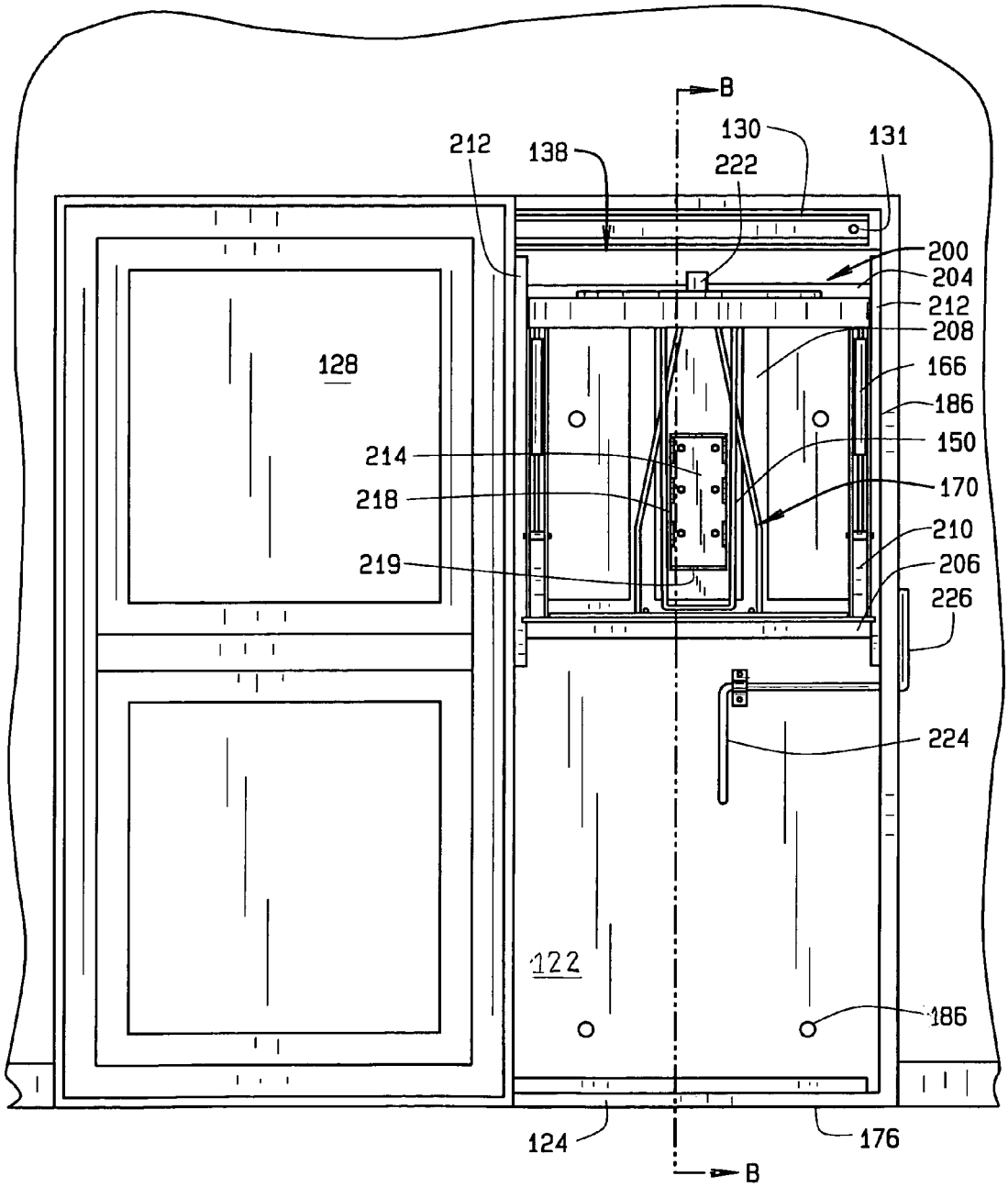
FIG. 8. is a front elevational view of the second embodiment of the invention shown as the ironing board storage device of FIG. 6 with a door in an open position and the ironing board in the operating position.

The frame assembly 200 includes a generally rectangular frame member 202 having generally horizontal upper and lower members 204 and 206 connected by generally vertical inner and outer members 208 and 210, for supporting the ironing board 112, lift mechanism 116, and guide assembly 118 (FIG. 8). The outer members 210 are moveably attached to the housing 114 with frame slides 212, such as drawer slides or the like, which are mounted generally vertically along the inner face of the sidewalls 120 so that the frame member 202 can slide upwardly and downwardly between different elevations.

Figure 10:
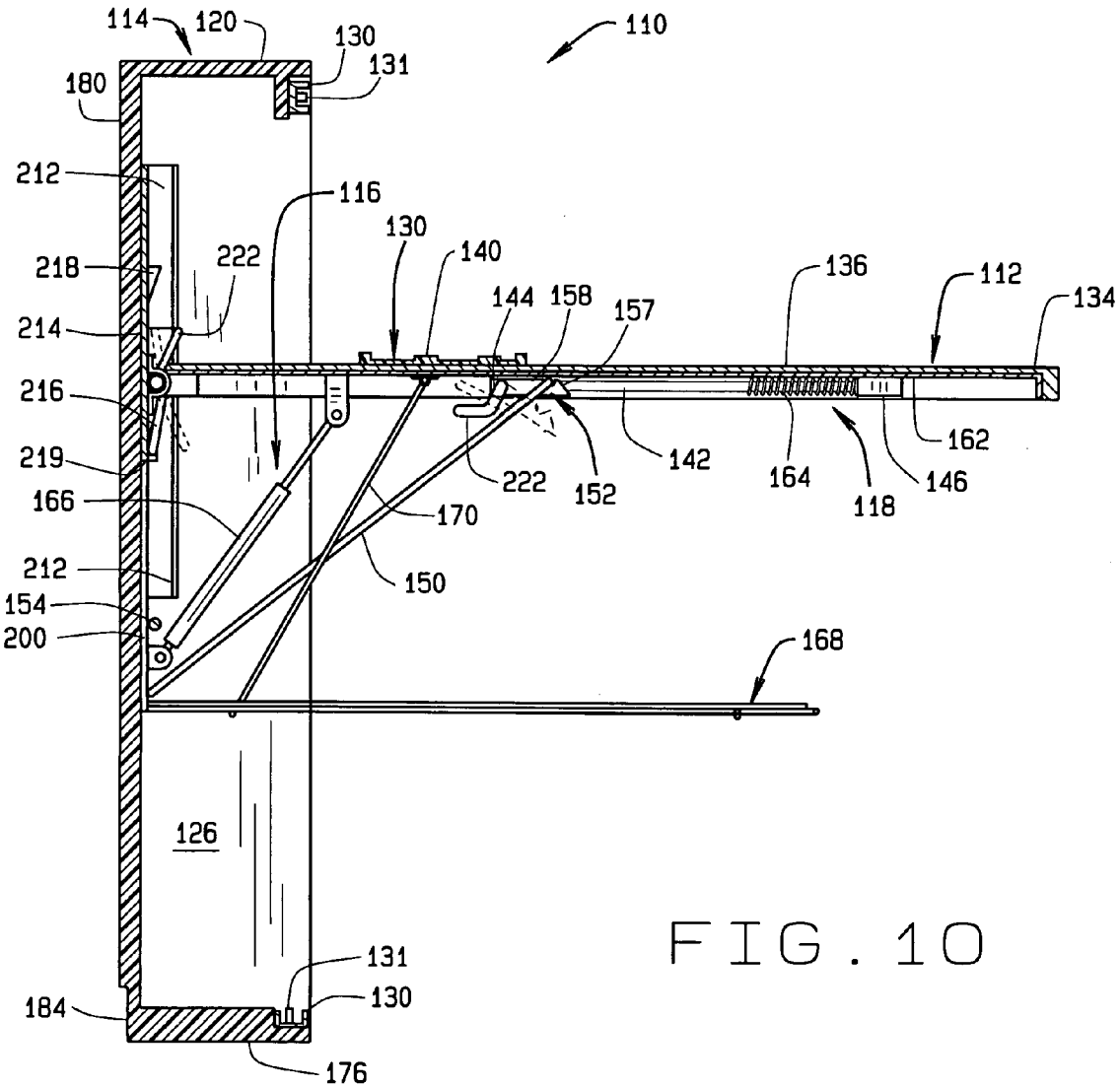
FIG. 10 is a section view of the second embodiment of the invention shown as the ironing board storage device along B-B of FIG. 7 with the door in an open position and the ironing board in the operating position at a lowest elevation.
Figure 11:
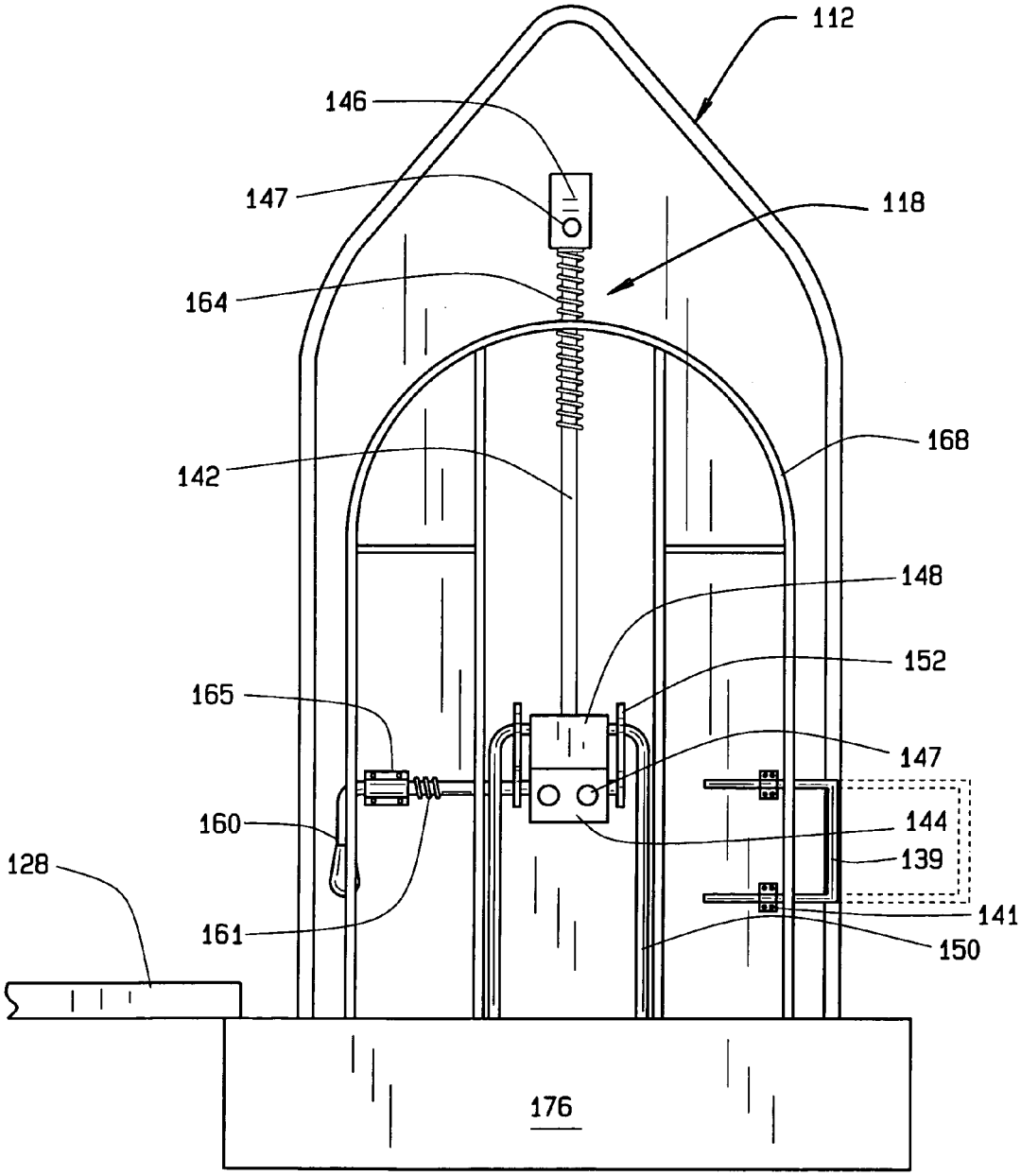
FIG. 11 is a bottom view of the second embodiment of the invention as the ironing board storage device of FIG. 6 in the operating position.
Figure 12:
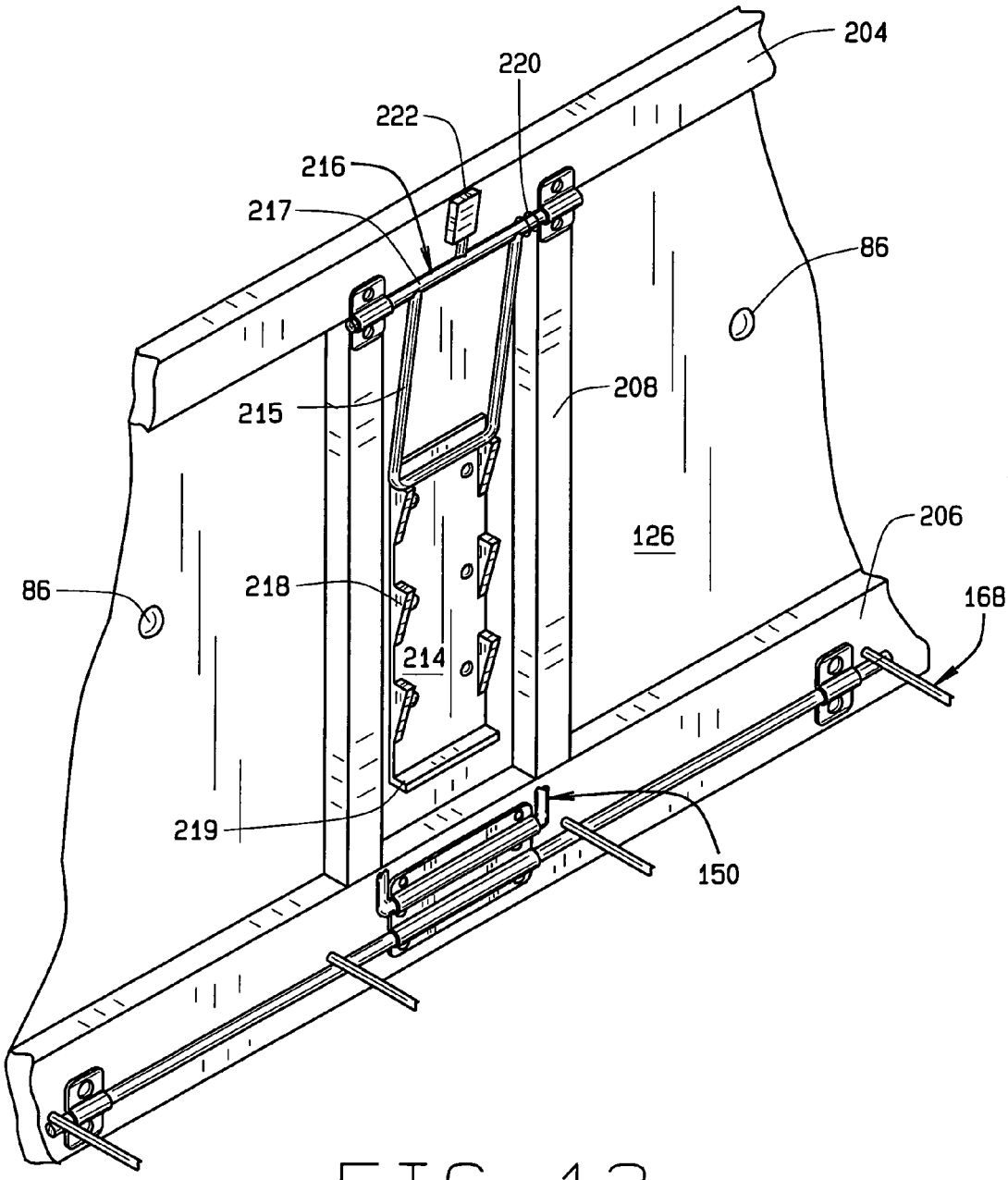
FIG. 12 is an enlarged view of a ratchet and pawl of the second embodiment of the invention.

The frame assembly 200 also includes a positioning device, such as a ratchet 214 and pawl 216 (FIG. 12), capable of positioning and securing the frame member 202 at different elevations (FIGS. 9 and 10). In the embodiment of FIGS. 6-12, the ratchet 214 is shown as a vertical rack attached to the housing rear panel 122. The ratchet 214 includes detents, such as sloping teeth 218, which are positioned at multiple elevations to engage the pawl 216. The detent at the lowest elevation is shown as a protruding flange 219. The pawl 216 comprises a "U" shaped bar 215 secured as by welding to a straight bar 217 whose ends are pivotally secured as by brackets to the frame upper member 204 so that the pawl 216 pivots relative to the frame member 204. A biasing element, such as a torsion spring 220, biases the pawl 216 inwardly towards the rear panel 122 and into engagement with the ratchet 214. In alternate embodiments, the torsion spring 220 can be replaced with other appropriate biasing elements and structured to orient biased movement of the pawl 216 inwardly towards the rear panel 122 and into engagement with the ratchet 214, such as, extension springs, conical springs, helical springs, leaf springs, spiral springs, cantilever springs, gas springs, Belleville springs, rubber bands, and the like.

A handle 222 extends upwardly from the pawl bar 217, which can be engaged by the user to pivot the pawl 216 between engaged and disengaged positions. In the engaged position, the pawl 216 is positioned inwardly towards the rear panel 122 and engaged with the ratchet 214 to secure the frame member 202 at a predetermined elevation. In the disengaged position, the pawl 216 is positioned outwardly away from the rear panel 122 and disengaged from the ratchet to allow the frame member 200 to slide upwardly and downwardly between different elevations. In this way, the user can engage the frame assembly 200 to adjust the elevation of the frame assembly 200 and ironing board 112 to a predetermined elevation, such as the highest elevation shown in FIG. 9 and the lowest elevation shown in FIG. 10. It should be noted that the slope of the teeth 218 allows the frame member 202 to move upwardly without the user engaging the pawl 216. However, once the pawl 216 is positioned above a selected one of the teeth 218, the teeth 218 prevent any downward motion of the frame member 202 unless the user pivots the pawl 216 to the disengaged position.

Those skilled in the art will recognize that any number of detents can be used and any number of predetermined elevations can be used. Also, the detents can be any appropriate shape or size that engage the pawl. In addition, other embodiments of the ratchet and pawl can be used, such as a rack and pinion. (INVENTOR: WHAT OTHER DEVICES COULD BE USED?)

The ironing board 112 is embodied as a typical ironing board with a generally rectangular proximal portion 132 and a generally narrowing nose distal portion 134, such as a narrowing nose. The proximal portion 132 is moveably mounted, preferably pivotally, to the frame upper member 204 and supported by the guide assembly 118. However, those skilled in the art will recognize that any shape of ironing board can be used. A cover 136 fits over the ironing board 112 and includes a binding (not shown), including but not limited to a bungee cord, elastic, or drawstring, positioned around the perimeter of the cover 136 for securing the cover 136 to the ironing board 112. The cover 136 can be made of cotton as known in the art, or can be made from material with burn/scorch resistant characteristics, such as disclosed in U.S. Pat. No. 5,566,481. In other embodiments, the cover 136 includes multiple layers of materials, including but not limited to a layer of foam padding.

A heat-resistant and waterproof panel 138 identical to panel 38 previously described above, can be secured to the ironing board cover 136. Those skilled in the art will recognize that other heat-resistant and/or waterproof panels can be used. While the present embodiment shows a generally rectangular shaped panel 138 secured to a rear portion of the cover 36, other shapes, including but not limited to circular, trapezoidal, or oblong can be provided. Further, other sizes and locations can be used. If desired, the ironing board storage device 10 can be used without the waterproof panel 138.

The guide assembly 118 (FIGS. 9-10) includes a guide rod 142 mounted to the lower surface 162 of the ironing board 112 with a pair of mounting blocks 144 and 146. The blocks 144 and 146 include bores 145 for receiving the guide rod 142, and mount to the lower surface 162 with fasteners 147, such as screws, bolts, nails, and the like. A guide block 148 (FIG. 11) has bores 149 sized to snugly but slidably receives the guide rod 142 so that the guide block 148 can slide back and forth along the guide rod 142. A support brace 150, comprising a generally rectangular bar, moveably, preferably pivotally, connects between the guide block 148 and the frame lower member 206 as by brackets to correlate the movement of the guide block 148 with the movement of the ironing board 112. As a result, when the guide block 148 slides back and forth along the guide rod 142, the ironing board 112 pivots between the operating position and the storage position. The support brace 150 is shown preferably generally flat with a generally rectangular configuration although it can have other shapes such as U-shaped, circular, elliptical, oblong, and square.

A support bracket 139 is moveably, preferably slidably, attached to the ironing board lower surface 162 for supporting an iron (FIG. 11) with an appropriate fastener 141, such as screws, bolts, nails, and the like. The support bracket 139 is a generally U-shaped bar that can move between an extended position for supporting an iron and a retracted position for storage. In the extended position, the support bracket 139 extends generally horizontally from the side of the ironing board 112 so that an iron (not shown) can rest upon the bracket 139. In the retracted position, the support bracket 1390 resides underneath the ironing board 112 so that it does not interfere with storage of the ironing board 112 within the housing 114. In operation, the user extends the support bracket 139 and places the iron directly on the bracket 139. The bracket 139 can be made from any material which can withstand the temperatures associated with direct contact with an operating iron, such as metal, plastic, and the like.

When the ironing board 112 is in the operating position, the support brace 150 engages a latch 152 for support during operation. The latch 152 is a generally horizontal bar 154 moveably, preferably pivotally, attached to the proximate mounting block 144 and having arms 156 extending perpendicularly from the bar 154, which are adjacent each side of the proximate mounting block 144. Each arm 156 includes sloped portions 157 and a notch 158 that engages and receives the support brace 150 as the ironing board 112 pivots to the operating position. As the ironing board 112 pivots upwardly, the support brace 150 contacts the sloped portions 157, which pivots the arms 156 downwardly until the notches 158 receive the support brace 150. Upon being received by the notch 158, the arms 156 pivot upwardly due to a biasing element, such as a torsion spring 161, so that the notch 158 engages the support brace 150 and supports the ironing board 112 in the operating position. In this way, the support brace 150 stabilizes the ironing board 112 during operation. The bar 154 pivotally mounts to the ironing board lower surface 162 with an appropriate fastener 165 and terminates in a handle 160. When the ironing board 112 is in the operating position, the operator can engage the handle 160 to pivot the arms 156 downwardly and release the support brace 150 so that the ironing board 112 can be manually pivoted downward to the storage position.

The lift mechanism 116 includes biasing elements, such as a helical compression spring 164 mounted along the guide rod 142 and a pair of cylinders 166 moveably, preferably pivotally, mounted between the frame lower member 206 and the ironing board 112. The lift mechanism 116 also includes a lever device 224, such as one comprising a bar. The lever 224 includes a handle 226 that pivotally attaches to the housing rear panel 122 and extends through the housing sidewall 120. In the storage position, the cylinders 166 are generally parallel with and unable to extend and pivot the ironing board 12. For this reason, the operator can engage the handle 226 to pivot the lever 224 upwardly so that the lever 224 presses against an ironing board lower surface 162 and initiates upward movement of the ironing board 112. At the same time, the compression spring 164 biases the guide block 148 towards the distal end of the ironing board 112, thereby, pivoting the ironing board 112 upwards to an angle of about 20°. At this angle, the cylinders 166 extend to pivot the ironing board 112 upwardly to the operating position. Although the cylinders 166 of embodiment of FIGS. 6-11 are preferably air cylinders, any type of biasing element can be used, such as hydraulic cylinders or the like.

In alternate embodiments, the compression spring 164 can be replaced with other appropriate biasing elements and structured to orient biased movement of the ironing board to pivot upwardly, such as torsion springs, extension springs, conical springs, helical springs, leaf springs, spiral springs, cantilever springs, gas springs, Belleville springs, rubber bands, and the like. However, a helical compression spring, such as shown, is preferable because it is helical to provide better and more effective use of space, orientation, and material.

The storage device 110 also includes a shelf 168 moveably, preferably pivotally, mounted to the frame lower member 206 and operatively connected to the ironing board 112 with a shelf bracket 170. The shelf 168 comprises a perimeter bar 172 having a generally U-shaped configuration and longitudinal struts 174, which are joined at their ends as by welding to the perimeter bar 172. The proximal end of the shelf 168 is moveably, preferably pivotally, attached to the frame lower member 206 so that the shelf 168 can pivot upwardly and downwardly. The shelf bracket 170 moveably, preferably pivotally, attaches between the longitudinal struts 174 and the ironing board lower surface 162 so that the movement of the shelf 168 corresponds with the movement of the ironing board 112. Therefore, the shelf 168 remains generally parallel with the ironing board 112 as it moves between the storage position and the operating position. All of the described parts of the support 130 are preferably of metal, such as of stainless steel. They could be, however, of durable plastic or other suitable material. The shelf 130 is shown preferably generally flat with a generally U-shaped overall configuration although it can have other shapes such as for example circular, elliptical, oblong, or square.

When installed, a housing bottom surface 176 can rest on a surface, such as support surface 178, which is preferably a floor, with the rear panel outer surface 180 abutting a wall 182. The rear panel outer surface 180 can include a channel 184 for receiving molding, which is typically located along bottom edge of the wall 182, so the storage device 110 can abut flush against the wall 182. Because the housing 114 rests on the support surface 178, the storage device 110 can be secured to the wall 182 with a minimal amount of fasteners 186, such as anchor bolts, drywall screws, nails and the like. This allows the storage device 110 to be easily removed while only leaving small holes from the fasteners 186, which can easily be repaired. In addition, the placement of the storage device 110 is not limited by the location of any support studs within the wall 182.

Figure 7:
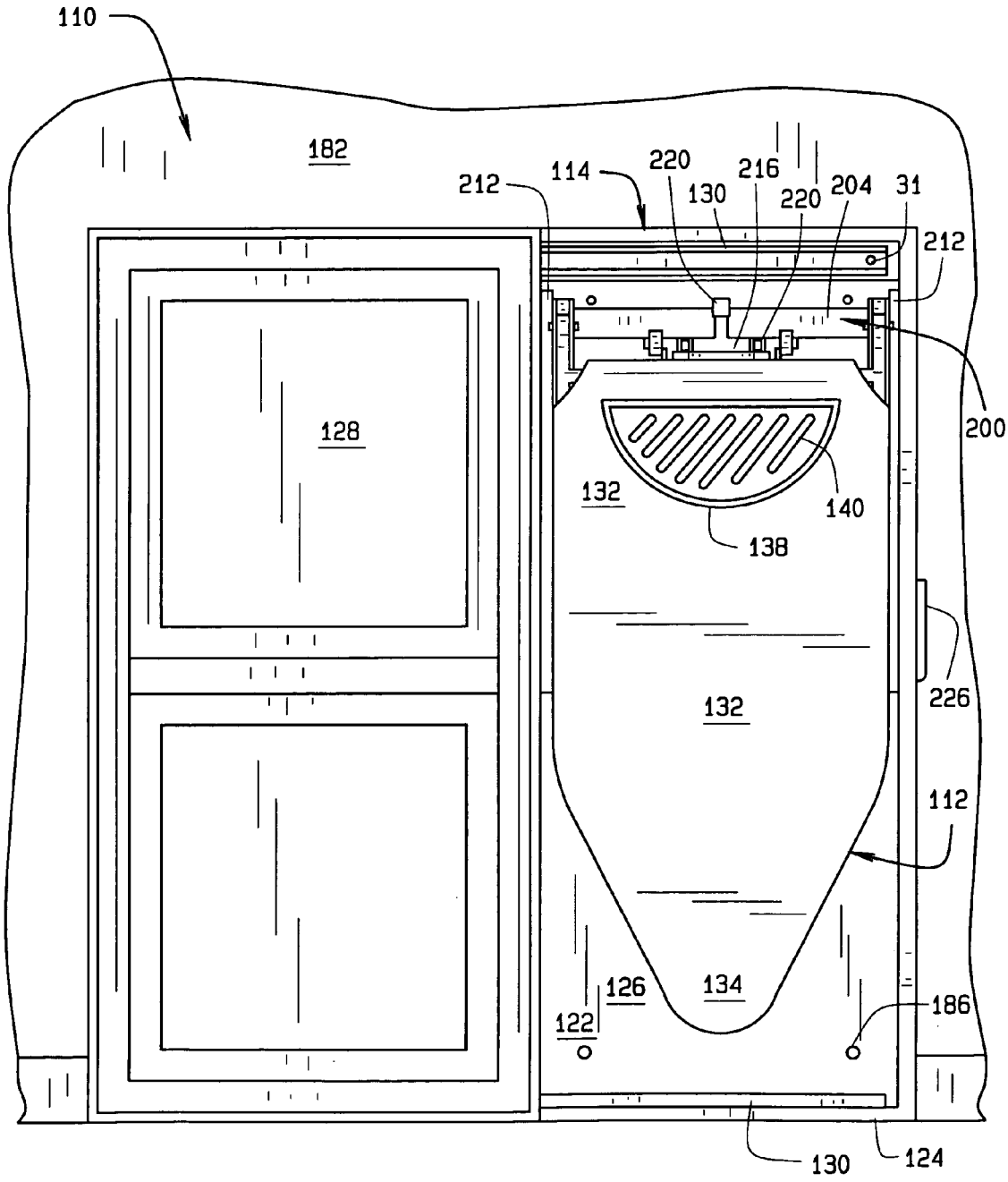
FIG. 7 is a front elevational view of the second embodiment of the invention shown as the ironing board storage device of FIG. 6 with a door in an open position and the ironing board in the storage position.

In operation, the operator slides the door 128 to the open position to access the ironing board 112, as shown in FIG. 7. The operator engages the lever handle 226 to pivot the lever 224 and initiate the upward movement of the ironing board 112 from the storage position. The lift mechanism 116 automatically pivots the ironing board 112 upward until the latch 152 engages the support brace 150, thereby securing the ironing board 112 in the operating position. The operator engages the pawl handle 222 and disengages the pawl 216 from the ratchet 214. The operator slides the frame assembly 200 upwardly or downwardly until the ironing board 112 is located at an appropriate elevation for ironing. When the operator has finished ironing, he or she engages the handle 160 to release the support brace 150 from the latch 152. The operator manually pivots the ironing board 112 downwardly to the storage position and slides the door 128 to the closed position.

Changes can be made in the above constructions without departing from the scope of the invention, it is intended that all matter contained in the above description or shown in the accompanying drawings shall be interpreted as illustrative and not in a limiting sense.

What is claimed is:

1. An ironing board storage device, comprising:

a housing;

an ironing board having a proximal end and a distal end, the ironing board being moveably connected to the housing for movement between a substantially vertical storage position wherein the ironing board proximal end is above the ironing board distal end, to a substantially horizontal operating position wherein the ironing board proximal end is closer to the housing than the ironing board distal end;

a lift mechanism operatively associated with the ironing board and housing for raising the ironing board from the substantially vertical storage position to the substantially horizontal operating position; and a door moveably attached to the housing with tracks so that the door slides between an open and closed position.

2. The ironing board storage device of claim 1, the lift mechanism comprising:

at least one biasing element mounted between the housing and the ironing board distal end for biasing the ironing board upwardly; and at least one biasing element mounted between the housing and the guide assembly that initiates upwardly movement of the ironing board.

3. The ironing board storage device of claim 2, the biasing element comprising:

a cylinder being capable of extending to raise the ironing board to the operating position.

4. The ironing board storage device of claim 2, the biasing comprising:

a compression spring that biases the ironing board upwardly.

5. The ironing board storage device of claim 1, the lift mechanism comprising:

at least one biasing element operatively connected between the housing and the ironing board, whereby the biasing element raises the ironing board to the operating position.

6. The ironing board storage of claim 1, further comprising:

a guide assembly operatively associated with the ironing board and the housing that supports the ironing board in the operating position.

7. The ironing board storage of claim 6, the guide assembly further comprising:

an upper mounting block mounted to the housing;

a lower mounting block mounted to the housing;

a guide rod mounted between the upper mounting block and lower mounting block;

a guide block engaged with the guide rod so that the guide block is capable of movement along the guide rod to guide the ironing board between the storage position to the operating position;

a support brace moveably mounted between the guide block and the ironing board, wherein the support brace correlates the movement of the ironing board with the movement of the guide block;

a latch moveably attached to the upper mounting block so that the latch is capable of securing and releasing the support brace.

8. The ironing board storage of claim 7, the guide assembly comprising:

a support brace moveably mounted to the ironing board, wherein the support brace correlates the movement of the ironing board with the movement of the guide block;

a latch capable of securing the support brace in the operating position.

9. The ironing board storage of claim 7, the guide assembly further comprising:

a biasing element coupled with the guide rod that is capable of biasing the guide block upwardly.

10. The ironing board storage of claim 1, further comprising:

a guide assembly operatively associated with the ironing board and the housing, the guide assembly being moveably connected to the ironing board to initiate the movement of the ironing board from the storage position to the operating position.

11. The ironing board storage device of claim 1, wherein the housing is capable of resting on a support surface in an upright position.

12. The ironing board storage device of claim 1, wherein the housing is capable of being removably secured to a wall in an upright position.

13. The ironing board storage of claim 1, further comprising a shelf operatively connected between the housing and the ironing board.

14. An ironing board storage device, comprising:

a housing;

an ironing board having a proximal end and a distal end, the ironing board being moveably connected to the housing for movement between a substantially vertical storage position wherein the ironing board proximal end is above the ironing board distal end, to a substantially horizontal operating position wherein the ironing board rear end is closer to the housing than the ironing board front end;

a means for automatically raising the ironing board to the substantially horizontal operating position;

a guide assembly moveably connected to the ironing board to initiate the movement of the ironing board from the storage position to the operating position comprising;

an upper mounting block mounted to the housing;

a lower mounting block mounted to the housing;

a guide rod mounted between the upper mounting block and lower mounting block;

a guide block engaged with the guide rod so that the guide block is capable of movement along the guide rod to guide the ironing board between the storage position to the operating position;

a support brace moveably mounted between the guide block and the ironing board, wherein the support brace correlates the movement of the ironing board with the movement of the guide block; and a latch moveably attached to the upper mounting block so that the latch is capable of securing and releasing the support brace.

15. The ironing board storage of claim 14, the guide assembly further comprising:

a biasing element coupled with the guide rod that is capable of biasing the guide block upwardly.

16. The ironing board storage of claim 14, further comprising a shelf operatively connected between the housing and the ironing board.

17. The ironing board storage device of claim 14 wherein the means for automatically raising the ironing board comprises:

a means for positioning the ironing board at different elevations.

18. The ironing board storage device of claim 14 wherein the means for automatically raising the ironing board comprises:

at least one biasing element connected between the housing and the ironing board for biasing the ironing board upwardly.

19. The ironing board storage device of claim 18 wherein the biasing element comprises:

at least one cylinder operatively connected between the housing and the ironing board, whereby the cylinder extends to raise the ironing board to the operating position.

20. The ironing board storage device of claim 18, wherein the biasing element comprises:

a compression spring that biases the ironing board upwardly.

21. An ironing board storage device, comprising:

a housing;

a frame assembly moveably mounted within the housing for movement between different elevations;

an ironing board having a proximal end and a distal end, the ironing board being moveably connected to the frame assembly for movement between different elevations and for movement between a substantially vertical storage position wherein the ironing board proximal end is above the ironing board distal end, to a substantially horizontal operating position wherein the ironing board proximal end is closer to the housing than the ironing board distal end; and a lift mechanism operatively associated with the ironing board and the frame assembly for raising the ironing board from the substantially vertical storage position to the substantially horizontal operating position.

22. The ironing board storage of claim 21, further comprising:

a guide assembly operatively associated with the ironing board and the frame assembly that supports the ironing board in the operating position.

23. The ironing board storage of claim 21, further comprising:

a guide assembly operatively associated with the ironing board and the frame assembly, the guide assembly being moveably connected to the ironing board to initiate the movement of the ironing board from the storage position to the operating position.

24. The ironing board storage of claim 21, the guide assembly further comprising:

a proximal mounting block mounted to the ironing board;

a distal mounting block mounted to the ironing board;

a guide rod mounted between the proximal mounting block and distal mounting block;

a guide block engaged with the guide rod so that the guide block is capable of movement along the guide rod to guide the ironing board between the storage position to the operating position;

a support brace moveably mounted between the guide block and the frame assembly, wherein the support brace correlates the movement of the ironing board with the movement of the guide block; and a latch moveably attached to the upper mounting block so that the latch is capable of securing and releasing the support brace.

25. The ironing board storage of claim 24, the guide assembly comprising:

a support brace moveably mounted to the ironing board, wherein the support brace correlates the movement of the ironing board with the movement of the guide block; and a latch capable of securing the support brace in the operating position.

26. The ironing board storage of claim 24, the guide assembly further comprising:

a biasing element coupled with the guide rod that is capable of biasing the guide block towards the ironing board distal end.

27. The ironing board storage device of claim 21, the lift mechanism comprising:

at least one biasing element mounted between the frame assembly and the ironing board distal end that biases the ironing board upwardly; and at least one biasing element mounted between the frame assembly and the guide assembly that initiates upward movement of the ironing board.

28. The ironing board storage device of claim 27, the biasing element comprising:

a cylinder being capable of extending to raise the ironing board to the operating position.

29. The ironing board storage device of claim 27, the biasing element comprising:

a compression spring that biases the ironing board upwardly.

30. The ironing board storage device of claim 21, the lift mechanism comprising:

at least one biasing element operatively connected between the frame assembly and the ironing board, whereby the biasing element raises the ironing board to the operating position.

31. The ironing board storage of claim 21, further comprising:

a door moveably attached to the housing with tracks so that the door slides between an open and closed position.

32. The ironing board storage device of claim 21, wherein the housing is capable of resting on a support surface in an upright position.

33. The ironing board storage device of claim 21, wherein the housing is capable of being removably secured to a wall in an upright position.

34. The ironing board storage of claim 21, further comprising:

a shelf operatively connected between the housing and the ironing board.

35. The ironing board storage of claim 21, the frame assembly comprising:

a frame member moveably mounted to the housing with tracks so that the frame member slides vertically between different elevations.

36. The ironing board storage of claim 35, the frame assembly further comprising a positioning device operatively associated with the ironing board and with the frame member for positioning and securing the frame member at different elevations.

37. The ironing board storage of claim 36, the positioning device comprising:

a ratchet and pawl device operatively associated with the ironing board and with the frame member for positioning and securing the frame member at different elevations.

38. The ironing board storage of claim 37, the ratchet and pawl device comprising:

a rack associated with to the housing, the rack having at least one detent positioned at a predetermined elevation; and a pawl pivotally mounted relative to the frame member, the pawl being capable of movement between engagement with the at least one detent and disengagement with the at least one detent.

39. The ironing board storage of claim 38, the ratchet and pawl device further comprising:

at least one biasing element operatively connected to the pawl and being capable of biasing the pawl to towards the engagement position.

40. The ironing board storage of claim 38, the detent comprising a sloping tooth that prevents downward movement of the frame member while the pawl is in the engagement position and allows upwardly movement of the frame member while the pawl is in the disengagement position.

* * * * *